United States Patent [19]

Hergeth et al.

[11] Patent Number: 4,498,215

[45] Date of Patent: Feb. 12, 1985

[54] APPARATUS FOR CONVEYING MATERIAL AS IT IS REMOVED FROM ROWS OF BALES CONSTITUTING SPINNING MATERIAL

[75] Inventors: Hubert Hergeth; Helmut Hergeth, both of Dulmen, Fed. Rep. of Germany

[73] Assignee: Hergeth Hollingsworth GmbH, Dulmen, Fed. Rep. of Germany

[21] Appl. No.: 490,849

[22] Filed: May 2, 1983

[30] Foreign Application Priority Data

May 7, 1982 [DE] Fed. Rep. of Germany ..... 3217184

[51] Int. Cl.[3] ..... D01G 9/00; B65G 53/26; B65G 53/52

[52] U.S. Cl. ..... 19/81; 19/97.5; 19/205; 241/101 A

[58] Field of Search ..... 19/80 R, 81; 241/101 A, 241/97.5, 205

[56] References Cited

U.S. PATENT DOCUMENTS 2,712,675 7/1955 Gwaltney et al. ..... 19/81 X 4,365,764 12/1982 Marx ..... 19/80 R

*Primary Examiner*—Louis K. Rimrodt

*Attorney, Agent, or Firm*—Diller, Ramik & Wight

[57] ABSTRACT

This disclosure relates to an apparatus for conveying material as it is removed from rows of bales for subsequent utilization during a spinning operation, the apparatus including a generally elongated channel having an elongated longitudinally disposed slot, a frame movable along rails on opposite sides of the channel, the frame carrying a carriage pivoted thereto along with a telescopic tube for delivering material removed from bales to the channel, a flexible belt, a first end of the flexible belt being secured to an end of the channel, a second end of the flexible belt being entrained about a drum such that the flexible belt can be placed in overlying relationship to the slot upon movement of the frame along the rails whereby material delivered into the channel is covered by the belt and a drive mechanism for appropriately rotating the drum to wind and unwind the belt during movement of the frame along the rails.

23 Claims, 6 Drawing Figures

FIG.1
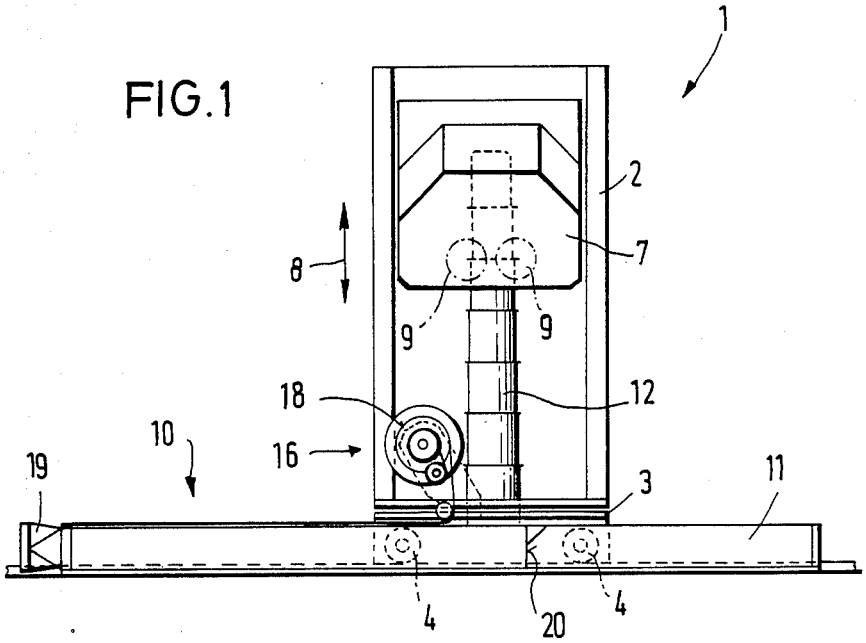
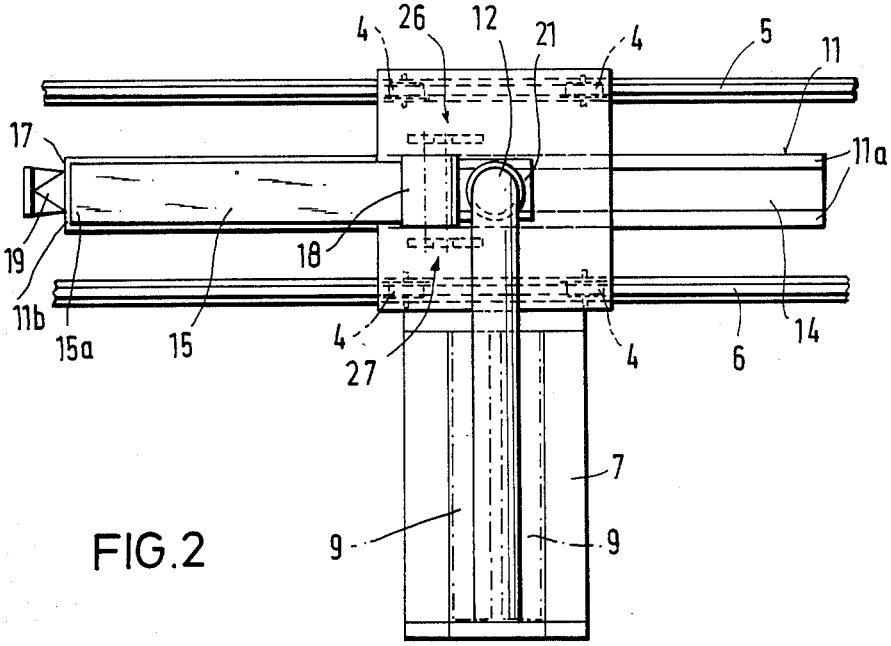
FIG.2

APPARATUS FOR CONVEYING MATERIAL AS IT IS REMOVED FROM ROWS OF BALES CONSTITUTING SPINNING MATERIAL

This invention relates to a novel apparatus for conveying material as it is removed from rows of bales of spinning material such as cotton, synthetic fibers, or the like.

Conventional conveying devices are known in which a frame is reciprocated along a pair of rails. The frame carries a cantilever extension which is disposed transversely to the direction of frame travel and can be relatively adjusted in height. The cantilever portion carries conventional reducing means, such as one or plurality of driven milling rolls. The frame is somewhat tower-shaped and as it moves along the row of bales, the driven milling rolls mill flocks or fibers from the upper surface portion of adjacent bales. As the flocks are removed, they are drawn by appropriate suction means through a telescopic tube carried by the frame and the tube delivers these materials to a channel housed between a pair of rails. The milling or reducing mechanisms which reciprocate adjacent the bales along the channel, the outlet of the telescopic delivery tube and the channel itself accompanies the tower-shaped frame as it moves along the rails.

A top side of the conventional channel or suction channel is covered during the reciprocal motion of the frame by a belt or the like. In one known embodiment, the latter is realized by a cover belt guided at its longitudinal edges or sides along the sides of the channel by means of large cylinders. The flock that is removed is dispensed or delivered into the channel through a hole in the frame which is displaced toward one end or the other of the channel. This creates low pressure in the channel and, thus, the edges of the belt are attracted by suction within the channel to the channel sides to seal against the latter, but the latter occurs only when the frame stops moving and the belt can be "sucked" against the channel sides. The borders or edges of the belt are, therefore, continuously shifted relative to the channel sides and this movement requires excessive energy and the frictional effect created thereby reduces belt life. Furthermore, if the cover belt is guided about the channel by several guide rolls, the resultant expenditure in cost is relatively high and the belt length is nearly three times that of the corresponding channel.

In accordance with the foregoing, it is an object of the present invention to provide a novel device of the type heretofore disclosed in which a frame is moved along a suction channel and carries a belt which can be progressively placed over or removed from the channel as the frame moves therealong, thus requiring relatively low constructional expenditures and low operating costs.

In further accordance with the present invention, the frame carries a carriage which in turn carries a winding device in the form of a drum to which one end of the belt is attached whereas an opposite end of the belt is attached to an end of the channel such that the belt can be progressively wound or unwound as the frame is reciprocated along the channel. With the latter arrangement, a portion of the belt is at all times in overlying sealed relationship to legs of the channel even if the frame moves away from the suction end of the channel. This construction also allows a belt to be used which is essentially the length of the channel thereby reducing considerably the cost of conventional belts which, as was noted earlier, might be nearly three times the length of their associated channel. Expensive guide rolls are unnecessary, nor do they require constant retightening and control since the belt or cover belt does not move relative to the channel but is merely progressively laid thereover or withdrawn therefrom.

In those cases where it is desired to exclude the unused suction channel portion from the sucking action, the channel can be provided with a transverse partition such as a transverse slide which is situated on the side opposite the telescopic delivery tube relative to the suction or working section of the channel into which material is being deposited. The partition within the channel prevents air from penetrating into the unused or inoperative channel portion or from being removed therefrom, and this thereby ensures that the material or flocks are drawn through the telescopic tube into the used portion of the suction channel under vacuum and are covered by the belt.

In further accordance with this invention, it is also possible to utilize a pair of cover belts and a pair of winding devices relative to a single frame or its associated carriage. In this case as one belt is wound from its drum, the other is unwound therefrom during carriage or frame movement along the associated channel. In this case, a partition traversing the suction channel is unnecessary because the removed flocks or material are only drawn in the suction direction through the telescopic tube and into the associated channel.

Because of the manner in which the cover belt (or belts) are arranged over the channel generally longitudinally relative thereto, the connecting pieces for flock discharge from the suction channel can be directed longitudinally therefrom. In other words, the material which can eventually be drawn from the channel for subsequent utilization in spinning machines can be drawn longitudinally outwardly of the channels without bending or deviation which is the more effective manner of discharge from the channel than heretofore provided.

Preferably the winding device or drum carried by the frame or carriage is rotated by a drive motor to ensure a correct winding or unwinding of the belt(s) relative thereto. Preferably a scroll spring motor is used as the drive motor which is wound up as the belt is extracted and, thus, can rewind the belt during retraction and, of course, reverse motion of the frame along its associated rails. Scroll spring motors will, of course, also reduce the constructional cost of the present equipment.

In accordance with the invention as just described, the belt can be easily disconnected from the suction channel and its winding within the frame and/or carriage permits the use of the frame and the associated belt with several different suction channels either in aligned or in parallel relationship. Therefore, it is possible to displace the frame and carriage with the cover belt from one suction channel to another suction channel by merely disconnecting and reconnecting the belts from one and to the other of these suction channels, respectively. Thus, in this manner bales can be milled with one and the same frame, carriage, and belt and no additional cover belt is required for additional suction channels.

Another advantage of the apparatus is that a very quick change is possible to reduce different sets of bales and much larger rows of bales can be prepared. Several channels can be fed from the bales and one and the same reducing means can be used to consecutively mill down a great number of bales. Thus, one person operating for a short period of time can quickly connect and disconnect the reducing means as necessary to process one bale, another bale, and so on. Furthermore, one can readily interrupt the process of one batch at a first suction channel and then simply move the carriage, frame, belt, etc., to another area its associated channel for milling down another bale, thereby increasing the flexibility of spinning mills to a considerable extent.

With the above and other objects in view that will hereinafter appear, the nature of the invention will be more clearly understood by reference to the following detailed description, the appended claims and the several views illustrated in the accompanying drawings.

IN THE DRAWINGS:

FIG. 1 is a schematic side view of a novel apparatus constructed in accordance with this invention, and illustrates milling rolls for feeding flocks removed from bales into a suction channel and covering the same with a belt drawn from a winding device.

FIG. 2 is a schematic top plan view of the apparatus of FIG. 1, and illustrates a pair of rails, the channel therebetween and a cantilevered portion carried by the frame in which milling rolls are utilized to remove flocks from bales for subsequent discharge into the suction channel.

Figure 3:
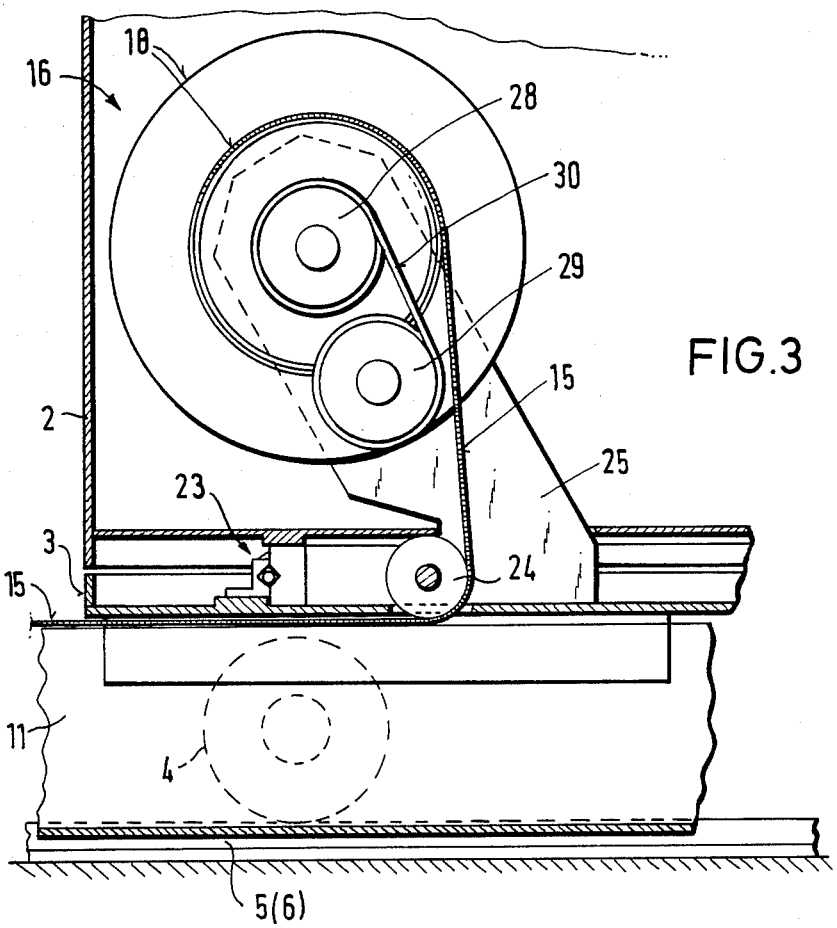
FIG. 3 is an enlarged fragmentary detailed view with parts thereof broken away and shown in section, and illustrates the manner in which a belt is withdrawn from a cylinder and rewound thereupon through a spring band or motor.

A novel apparatus constructed in accordance with this invention is illustrated in FIGS. 1 through 3 of the drawings and is generally designated by the reference numeral 1.

The apparatus 1 is designed to remove fibers or flocks from rows of bales of spinning material, e.g., of cotton and includes a movable frame 2 supported upon a carriage 3 which is reciprocated and guided along rails 5, 6 through appropriate wheels 4. The frame 2 has at one side thereof a cantilevered portion 7 which can be vertically adjusted in height, as is indicated by the double-headed arrow 8 in FIG. 1. The cantilevered portion 7 contains reducing means for processing the fibers or flocks from the bale tops and such reducing means may, for example, comprise a milling device such as conventional milling rolls 9, 9.

A device 10 is disposed below the frame 2 and the associated carriage 3, and the purpose thereof is to receive the flocks or fibers from the bales, at least temporarily store the same, after which the same may be removed from the device 10 for subsequent conveyance to spinning machines. The device 10 includes a suction channel 11 of a generally U-shaped cross-section opening upwardly and defining between legs 11*a* thereof (FIG. 2) an elongated longitudinal slot 14. A telescopic tube 12 carried by the frame 2 conveys the removed fibers or flocks from the milling rolls 9 to the suction channel 11 where the sucking or vacuum is effected by means of a fan or condenser (not shown). The fan or condensor may, for example, be housed outside of the suction channel 11 and being connected to the interior thereof through a plurality of openings along the length or legs 11*a* so that as the fan is energized, air will be drawn into the channel 11 through the upper slot 14 and along the length thereof to draw the material into the suction channel 11 from the telescopic tube 12 in a conventional manner.

The longitudinal slot 14 of the suction channel 11 is adapted to be covered and uncovered by a belt 15 which rests on the upper surfaces (unnumbered) of the legs 11*a*, 11*a*. Winding means in the form of a winding device 16 housed in the frame 12 or in the carriage 3 as provided for the belt or cover belt 15. One end 15*a* of the belt 15 is detachably secured to an end 11*b* of the suction channel 11 as, for example, by means of clamping means 17, while the other end of the belt 15 is connected to a cylinder 18 of the winding means or winding device 16. When the frame 2 moves away from the end 11*b* of the suction channel 11, the belt 15 is unwound from the winding device 16, thus covering the suction channel 11 to an extent dependent upon the position of the frame 2 relative to the channel 11. As was noted earlier, suction is drawn through the sides or legs 11*a* of the channel 11, and this creates a low pressure beneath the belt 15 in the area in which the belt 15 overlies these legs 11*a*. This same low pressure within the suction channel 11 draws the longitudinal edges (unnumbered) of the belt 15 against the upper faces (unnumbered) of the legs 11*a*, 11*a* of the suction channel 11. Thus, the material is drawn downwardly through the telescopic tube 12 and into the channel 11 in the area underlying the belt 15 which, of course, progressively covers the slot 14 as this material fills the channel and the carriage 3 moves along the channel (to the right as viewed in FIG. 2).

The suction channel 11 also includes a discharge piece or nozzle 19 which has an axis aligned with the longitudinal direction of the channel 11, thus doing away with rerouting of the material when it is pneumatically conveyed from the channel 11 for subsequent delivery to spinning machines.

A partition 20 is carried by and depends from the carriage 3, and the partition 20 projects into the channel 11 at a side of the telescopic tube 12 opposite that of the suction piece or nozzle 19 thereby preventing air from being removed from the other (uncovered) end of the channel 11. The partition 20 may, for example, comprise a transverse slide extractable laterally out of the channel 11. The partition 20 is preferaby secured to a cover plate 21 covering the suction channel 11 to the point at which the cover belt 15 adjoins the channel legs 11*a* and enclosing the lower end of the telescopic tube 12.

The frame 2 is preferably supported so as to be tiltable or rockable through 180° relative to the carriage 3 by tilting means in the form of a rotating, tilting or pivoting track 23 (FIG. 3).

The cover belt 15 extends through a slot (unnumbered) of a lower plate (also unnumbered) of the carriage 3 (FIG. 3) and is guided therethrough by a guide roller 24. The belt 15 is connected at one of its ends to a winding cylinder 18 supported upon a mounting bracket 15 which is firmly secured to the carriage 3. A conventional motor is provided to drive the winding cylinder 18 and the latter is preferably a scroll spring motor 26, 27 defined by two rolls 28, 29 interconnected by a spring band 30 which has the tendency to automatically wind itself from one roll 28 to the other at 29 and vice versa. The scroll spring motor 26, 27 is mounted conveniently adjacent the winding drum 18 in a conventional manner, although it is also possible to mount a suitable scroll spring motor within the winding drum 18. Another option is to mount conventional scroll spring motors or devices radially about the axis of the cylinder 18 and, of course, any other suitable motor, such as an electric motor may be used in place of the scroll spring motor 26, 27. Hence, as the carriage 3 is moved from right-to-left in FIGS. 1 and 3, the scroll spring motor 26, 27 is effective to wind the belt 15 upon the cylinder 18 whereas opposite movement results in the belt being unwound from the cylinder 18 and progressively guided by the guide roller 24 atop the legs 11*a* of the channel 11 thereby progressively closing the longitudinal slot 14.

Figure 4:
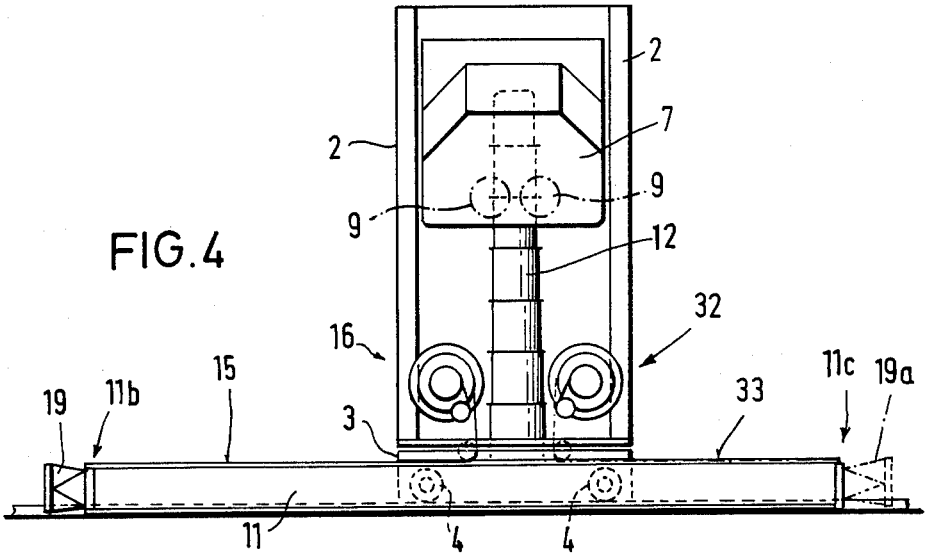
FIG. 4 is a schematic side elevational view of another apparatus constructed in accordance with this invention, and two belts are shown in association with a single suction channel.

Reference is now made to FIG. 4 of the drawings which illustrates another reducing means carried by frame 2 which houses a pair of winding devices or drums 16, 32 with the winding device 16 being associated with a cover belt 15 and the winding device 32 being associated with a cover belt 33. The winding devices or means 16, 32 are arranged as mirror-inversions of each other in a structural sense and, therefore, in a functional sense as the cover belt 15 is progressively removed from its winding device 16 to cover the suction channel 11 and the other belt 33 is wound upon the winding device 32 and vice versa. The belt 15 of the winding device 16 is also detachably secured to the end 11*b* of the suction channel 11 of FIG. 4, while the cover belt 33 is removalby connected to the other end 11*c* of the suction channel 11 (FIG. 4). Thus, the mechanism of FIG. 4 is essentially identical to that of FIGS. 1 through 3 except for the addition of the winding device 32 and associated cover belt 33. However, with the addition of the winding device 32 and the cover belt 33, the mechanism of FIG. 4 does not require the partition or partition plate 20, and this has been eliminated in the mechanism of FIG. 4. As in the apparatus of FIGS. 1 through 3, either end of the suction channel 11 can be fitted with suction pieces or discharge pieces 19, 19*a*. In lieu of slots along the legs 11*a* of the channel 11 which are connected to a fan to reduce the pressure within the suction channel 11, a fan or like suction device can be connected to both of the pieces 19, 19*a* and in the absence of slots in the legs 11*a* of the channel 11, suction is drawn or low pressure is created in the channel 11 from the area of the telescopic tube 12 to the left and to the right thereof. Thus, the fibrous material can be drawn by suction into the channel 11 to the left or to the right depending, of course, upon the direction of movement of the frame 2 relative to the rails (not shown).

Figure 5:
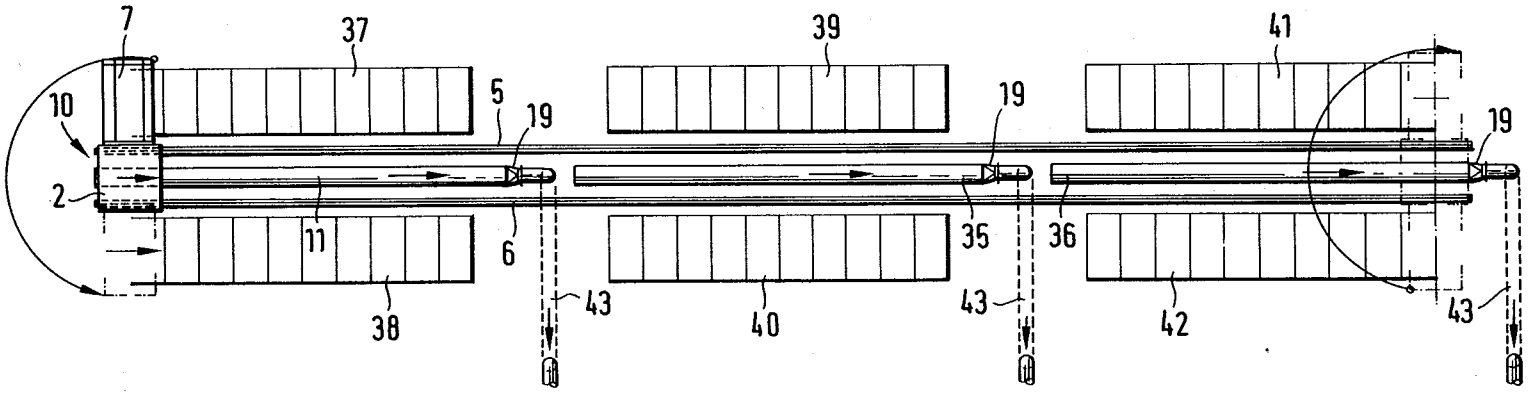
FIG. 5 is a top plan view of the apparatus, and illustrates the manner in which a single frame and its carriage can be moved along a single pair of rails between two or more in-line suction channels.
Figure 6:
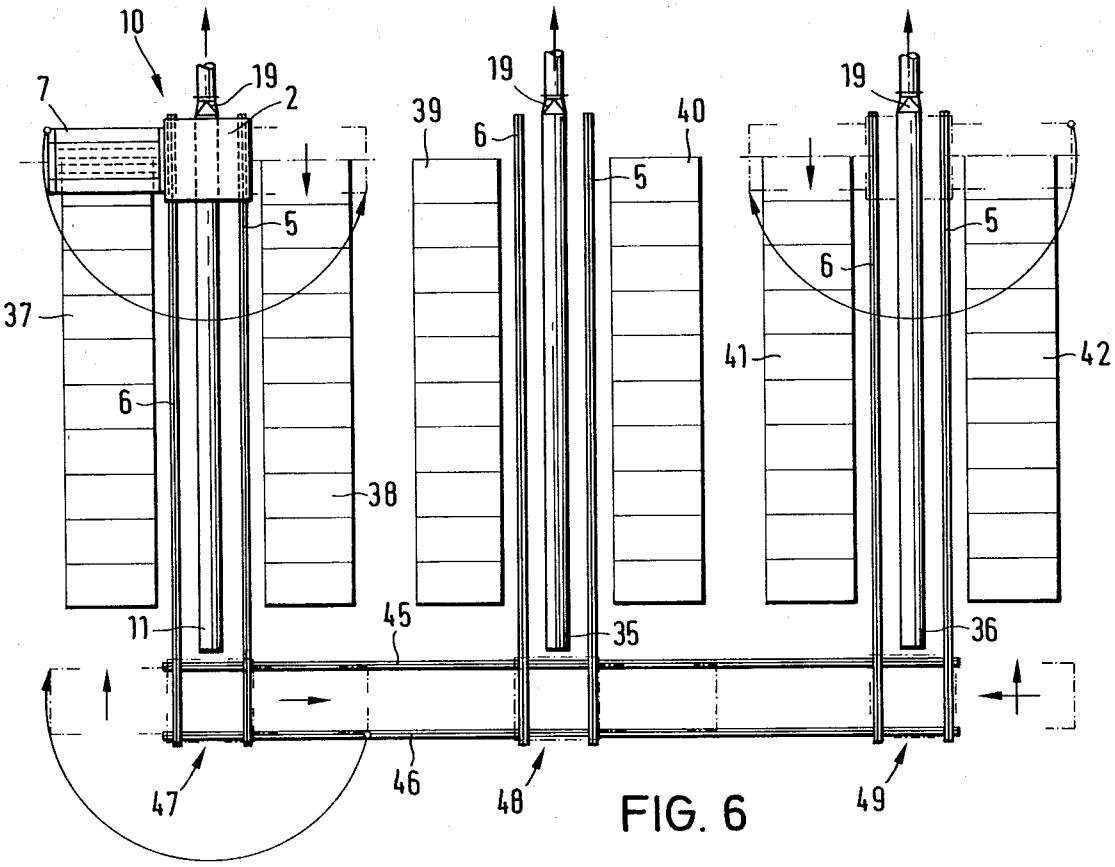
FIG. 6 is a top plan view similar to FIG. 5, but illustrates suction conveyors in spaced parallel relationship with appropriate transfer rails and turntable means therebetween.

In FIGS. 5 and 6 of the drawings, a single reducing means 10 is illustrated in association with a plurality of independent suction channels 11, 35 and 36 to which separate rows of bales are assigned. In FIG. 5 of the drawings, the suction channels 11; 35, and 36 are consecutively mounted in-line with bale rows 37, 38, associated with the suction channel 11; bale rows 39, 40 associated with the suction channel 35; and bale rows 41, 42 associated with the suction channel 36. The rails 5 and 6 extend continuously the total distance between the remotemost ends of the bails 37, 41 and 38, 42. If, for example, the reducing means 10 of the apparatus 1 is positioned at the left-handmost end of the channel 11 in FIG. 5 and the belt 15 is attached thereto, the apparatus 1 and/or its associated frame can move to the right across the entire channel in the manner indicated by the unnumbered headed arrows associated therewith in FIG. 5. At any time during the delivery of fiber or flocks to the channel 11 from the bales 37, 38, the apparatus 1 can be turned off, the belt 15 disconnected from the end of the channel 11, and the apparatus 1 simply rolled along the rails 5, 6 to the next suction channel 35 or the following suction channel 36, the belt 15 reattached, and the operation again begun. In this manner the bale rows 37, 38; 39, 40; and 41, 42 can be processed in virtually any optional order with one and the same apparatus 1 so as to obtain, for example, mixtures of different kinds of fibers/flocks from the different bales. The change can be performed quickly by essentially merely disconnecting the belt 15 from one of the channels and reconnecting it to the next channel into which material is to be discharged. Obviously, the same operation can be performed utilizing the apparatus of FIG. 4, but in this case both belts 15, 33 would have to be disconnected and/or reconnected during transfer of the carriage 2 between selected ones of the channels 11, 35 and 36.

The flocks removed by the milling rolls 9, 9 are preferably withdrawn or sucked off by pipes 43 positioned below the rails 5, 6 (FIG. 5). Thus, as the milling rolls 9 operate to reduce the flocks and discharge the same into the suction channel 11, the suction or negative pressure can be supplied to the channel 11 through one of the suction nozzles or discharge nozzles 19 via the pipes 43. In this manner the nozzles and pipes 43 can be used for both creating the negative pressure within the channel 11 during the operation of the apparatus 1 to draw the flock thereinto from the discharge end of the telescopic tube 12 as well as transfer the material within the channel 11 to spinning machines via the pipe 43.

Reference is now made to FIG. 6 of the drawings in which three independent suction channels 11, 35 and 26 are shown disposed in side-by-side generally parallel relationship. In this case, the rails 5, 6 are disposed in like pairs associated with each of the channels 11, 35 and 36. The rails 5, 6 are, however, interconnected by like rails 45, 46 normal to the rails 5, 6 and at each point of intersection there is provided conventional turntables 47, 48 and 49 which include as a part thereof rail sections (unnumbered) which correspond to and can be aligned with the rails 5, 6 and 45, 46. Thus, one of the machines, as shown associated with the conveyor 11, can be transferred from the position shown in FIG. 6 onto the rails (unnumbered) of the turntables 47, the latter rotated 90° in a conventional manner, and the carriage 2 is then shifted to the turntables 48 or 49 with the latter turntables being again rotated through 90° to shift the carriage 2 to the rails 5, 6 associated with the channel 35 or 36. Thus, one and the same apparatus 1 and its associated reducing means 10 can be associated with all of the rails 5, 6 and the bales 37 through 42 associated therewith in FIG. 6.

Although only a preferred embodiment of the invention has been specifically illustrated and described herein, it is to be understood that minor variations may be made in the apparatus without departing from the spirit and scope of the invention, as defined in the appended claims.

What is claimed is:

1. Apparatus comprising a generally elongated channel having an elongated longitudinally disposed slot, a frame, means for moving said frame along said channel, said frame including means for delivering material into and along said channel through said slot, a flexible belt, a first end of said flexible belt being secured to said channel, a second end of said flexible belt being secured to said frame, said flexible belt being adapted to be placed in overlying relationship to said slot upon movement of said frame along said channel whereby material delivered into said channel is covered by said belt, means carried by said frame for collecting and dispensing said belt during frame movement relative to said channel with belt dispensing taking place during material delivery, said belt collecting and dispensing means including a drum upon which said belt is adapted to be wound, and one of said first and second belt ends is secured to said drum.

2. The apparatus as defined in claim 1 including means for effecting rotation of said drum to collect thereupon and dispense therefrom said belt.

3. The apparatus as defined in claim 1 including means mounting said collecting and dispensing means for at least 180° tilting movement relative to said frame.

4. The apparatus as defined in claim 1 including means for discharging material from said channel.

5. The apparatus as defined in claim 1 including means having an axis generally aligned with the longitudinal axis of said channel for discharging material from said channel.

6. The apparatus as defined in claim 1 including means carried by said channel for discharging material from said channel, a partition traversing said channel, and said material delivering means being disposed between said material discharging means and said partition.

7. The apparatus as defined in claim 1 including means carried by said channel for discharging material from said channel, a transversely slidable partition normally traversing said channel but being removable therefrom, and said material discharging means and said partition being disposed at opposite sides of said material delivery means.

8. The apparatus as defined in claim 1 including means for effecting rotation of said drum to collect thereupon and dispense therefrom said belt, and said rotation effecting means includes a drive motor.

9. The apparatus as defined in claim 1 including means for effecting rotation of said drum to collect thereupon and dispense therefrom said belt, said rotation effecting means includes a drive motor, and said drive motor is a scroll spring motor.

10. The apparatus as defined in claim 1 wherein said material delivering means includes a telescopic tube.

11. The apparatus as defined in claim 1 wherein said material delivering means includes a telescopic tube having opposite end portions respectively adjacent and remote from said channel, and means for milling material before delivering the milled material to said tube remote end portion.

12. The apparatus as defined in claim 1 including a second flexible belt, a first end of said second flexible belt being secured to said channel at a point remote from the point said first-mentioned flexible belt first end is secured to said channel, a second end of said second flexible belt being secured to said frame, said material delivery means being disposed between said first-mentioned and second flexible belt second ends, said second flexible belt being adapted to be placed in overlying relationship to said slot upon movement of said frame along said channel whereby material delivered into said channel is covered by said first-mentioned belt upon movement of said frame toward said second belt first end and is also covered by said second belt upon movement of said frame toward said first-mentioned belt first end, and further means carried by said frame for collecting and dispensing said second belt during frame movement relative to said channel.

13. The apparatus as defined in claim 1 including a second flexible belt, a first end of said second flexible belt being secured to said channel at a point remote from the point said first-mentioned flexible belt first end is secured to said channel, a second end of said second flexible belt being secured to said frame, said material delivering means being disposed between said first-mentioned and second flexible belt second ends, said second flexible belt being adapted to be placed in overlying relationship to said slot upon movement of said frame along said channel whereby material delivered into said channel is covered by said first-mentioned belt upon movement of said frame toward said second belt first end and is also covered by said second belt upon movement of said frame toward said first-mentioned belt first end, further means carried by said frame for collecting and dispensing said second belt during frame movement relative to said channel, said further belt collecting and dispensing means includes a further drum, and means for effecting rotation of said drums to collect thereupon and disperse therefrom the respective belts.

14. The apparatus as defined in claim 1 including a second generally elongated channel having an elongated longitudinally disposed slot, and said frame moving means is disposed for moving said frame along said second channel whereby the slot thereof can be overlied by said belt.

15. The apparatus as defined in claim 14 wherein said first-mentioned and second channels are disposed in generally longitudinally aligned spaced relationship.

16. The apparatus as defined in claim 14 wherein said first-mentioned and second channels are disposed in generally side-by-side spaced parallel relationship and means for transferring said frame between said first-mentioned and second channels.

17. The apparatus as defined in claim 16 including turntable means at an intersection of said frame transferring means and each of said first-mentioned and second channels for rotating the frame during the transfer of said frame therebetween.

18. The apparatus as defined in claim 1 including means for removably securing said one belt end to said drum.

19. The apparatus as defined in claim 1 wherein said flexible belt has only a single belt portion overlying said slot.

20. The apparatus as defined in claim 1 including a second flexible belt, a first end of said second flexible belt being secured to said channel, a second end of said second flexible belt being secured to said frame, said second flexible belt being adapted to be placed in overlying relationship to said slot upon movement of said frame along said channel whereby material delivered into said channel is covered by said second belt. said belt collecting and dispensing means including a second drum upon which said second belt is adapted to be wound, and one end of said first and second belt ends of said second belt is secured to said second drum.

21. The apparatus as defined in claim 20 wherein said first and second flexible belts have portions lying in generally a common plane.

22. The apparatus as defined in claim 21 wherein each of said first and second drums is carried by said frame.

23. The apparatus as defined in claim 20 wherein each of said first and second drums is carried by said frame.

* * * * *